United States Patent [19]

Rowe

[11] 4,241,548

[45] Dec. 30, 1980

[54] GUTTER HANGER

[76] Inventor: Lacy A. Rowe, 1851 Skycoe Dr., Salem, Va. 24153

[21] Appl. No.: 97,676

[22] Filed: Nov. 27, 1979

[51] Int. Cl.[3] ..... E04D 13/00

[52] U.S. Cl. ..... 52/11; 248/48.2

[58] Field of Search ..... 52/11, 95; 248/48.1, 248/48.2

[56] References Cited

U.S. PATENT DOCUMENTS

| | | | |
|---|---|---|---|
| 2,928,634 | 3/1960 | Bender | 248/48.2 |
| 3,022,029 | 2/1962 | Blayden | 248/48.2 |
| 3,053,491 | 9/1962 | Ramser | 248/48.2 |
| 3,295,803 | 1/1967 | Blayden | 248/48.2 |
| 3,416,760 | 12/1968 | Sander | 248/48.2 |
| 3,426,987 | 2/1969 | Leslie | 248/48.2 |
| 3,436,878 | 4/1969 | Singer | 52/12 |
| 3,752,428 | 8/1973 | Trostle et al. | 248/48.2 |

*Primary Examiner*—Carl D. Friedman

[57] ABSTRACT

An improved gutter hanger is disclosed of one piece construction having an elongated body portion which horizontally spans the open top of a trough-shaped rain gutter, an upstanding support portion which projects upwardly from one end of the body portion above the gutter, and an upwardly and rearwardly facing hook portion at the other end of the body portion which interlocks with an oppositely directed hook-shaped front edge portion of the gutter. At least one upwardly projecting tongue, struck out of the upstanding support portion, engages under an inwardly and reversely bent rear upper edge portion of the gutter. A nail receiving hole extends through the upstanding support portion at a position above the upper extremity of the one or more tongues so that when a nail is driven through the hole into a building wall, the nail cooperates with the gutter hanger to support the gutter from the building wall and to securely lock the gutter against displacement without the nail piercing the gutter.

9 Claims, 7 Drawing Figures

GUTTER HANGER

BACKGROUND OF THE INVENTION

1. Field of the Invention

This invention relates to an improved gutter hanger and more particularly to a one-piece gutter hanger which interconnects the front and rear walls of a gutter and secured to a building wall by a nail, supports the gutter thereon and locks the gutter against displacement.

2. Description of the Prior Art

The prior art includes numerous gutter hangers for supporting a rain gutter on an outside building wall adjacent to the eaves. U.S. Pat. Nos. representative of the prior art are: 2,928,634; 3,022,029; 3,053,491; 3,295,803; 3,416,760; 3,426,987; 3,436,878; 3,752,428.

U.S. Pat. No. 3,416,760 is representative of a type of hanger which requires that a nail used in securing the hanger to a building wall be driven through the rear wall of the gutter. This type of hanger has the disadvantage that the nail punctures the gutter below the water line of a water filled gutter and permits rain water to seep through the punctured holes around the nail and into the woodwork into which the nail is driven, eventually causing the wood to rot.

U.S. Pat. Nos. 2,928,634, 3,022,029, 3,295,803, 3,426,987, 3,436,878 and 3,752,428 all show gutter hangers which may be nailed to a building wall without driving the nail through the gutter.

The hangers disclosed in U.S. Pat. No. 2,928,634 are structurally substantially different from the gutter hanger of this invention in that they require a relatively large spike of a length exceeding the width of the gutter from front to rear to be passed through the hanger and driven into the wood of a building wall. While the spike together with the hanger secure the gutter against vertical displacement, the use of a large spike which may split the woodwork of a building is a disadvantage. The present invention permits the use of a relatively small nail which is driven into the woodwork of a building through an upstanding support portion of the hanger. The small nail is less likely to damage the woodwork than the large spike, and yet its use with the gutter hanger of this invention firmly locks the gutter against displacement relative to the hanger.

While the hangers shown in U.S. Pat. Nos. 3,022,029, 3,053,491, 3,295,803, 3,426,987, 3,436,878 and 3,752,428 permit the use of relatively small nails instead of long spikes, the hangers differ substantially from the present invention in one or more important features which will be apparent from the description of the invention presented herein.

SUMMARY OF THE INVENTION

It is an object of the present invention to provide an improved gutter hanger of one-piece construction which inter-engages the front and rear walls of a trough-shaped rain gutter, and which includes an upstanding support portion which projects above the gutter when the gutter is supported by the hanger and a nail hole in the upstanding support portion located so that when a nail is driven therethrough into a building wall, the nail in cooperation with the gutter hanger firmly locks the gutter against displacement, without the nail piercing the gutter.

It is another object of the invention to provide an improved gutter hanger of one-piece construction in combination with an open top, trough-shaped rain gutter, for supporting the gutter from a vertical wall surface adjacent the eaves of a building. The gutter comprises a rear wall to be positioned against a vertical building surface, a bottom wall integral with the rear wall and extending upwardly from the bottom wall opposite the rear wall. The rear wall has an upper edge portion reversely bent inwardly to form a downwardly open rear gutter hook, and the front wall has an inwardly extending upper flange terminating in a reversely bent edge portion which forms a front gutter hook. The improved gutter hanger comprises an elongated linear body portion having an upwardly extending hook at one end for engaging the front gutter hook and an upstanding support portion at its other end. The upstanding support portion has at least one upstanding tongue struck therefrom and bent upright from the body portion. The main portion of the upstanding support portion is longer than the tongue and it is offset inwardly from the tongue by a distance at least equal to the thickness of the gutter material, so that the tongue can be snapped under the rear gutter hook and the upstanding support portion lifted to seat the tongue in the rear gutter hook. The upstanding support portion has a nail receiving hole extending therethrough above the upper edge of the tongue so that a nail may be driven through the hole into a vertical building surface for the support of said hanger and gutter without it piercing the gutter. The position of the nail receiving hole above the tongue is at least equal to the thickness of the gutter material or slightly greater to allow the nail to pass through the upstanding support portion above the upper edge of the rear gutter wall, yet it is sufficiently close to the upper edge of the gutter so that the nail will prevent upward movement of the gutter relative to the hanger and thus it locks the gutter hanger and gutter in assembled relationship.

Several variations of the upstanding support portion of the gutter hanger are disclosed. In two of the forms, the upstanding support portion has a single tongue struck therefrom while, in still another form, two tongues are struck from opposite sides of the upstanding support portion.

In one form the upper edge of the single tongue is notched and a tab depends from the upper edge of the opening from which the tongue is struck so that the tab prevents the upper edge of the opening from seating on the upper edge of the gutter when the upstanding support portion is nailed tight against a vertical wall of a building adjacent the eaves.

In one form of invention, the upstanding support portion is bowed inwardly away from the upright tongue, and it bows outwardly at its top edge so that the outwardly bowed top edge provides a spacer for spacing the main portion of the outstanding support portion outwardly from the vertical wall surface against which it is nailed. In two other forms of the invention, the upper edge of the upstanding support portion is reversely bent outwardly and downwardly to provide a spacer.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings, in which like characters of reference are used to designate like parts, and in which:

Referring to FIG. 1, one form of the gutter hanger of this invention is generally indicated by the reference numeral 10. The hanger 10 is of one-piece sheet metal construction which is bent to form an elongated linear body portion 11 having a central longitudinal reinforcing rib 12, an upwardly and rearwardly directed open front hook portion 13 at the front end 11'' of the body portion and an upstanding forwardly bowed flange 14 serving as a support portion at the rear end 11' of the body portion. The hook portion 13 includes an upstanding leg 15 which is bent upwardly from the front end of the body portion 11 substantially perpendicular thereto and a short rearwardly extending flange 16 which is bent from the upper end of the leg 15 into spaced parallel relationship with the body portion 11. The upstanding support portion 14 is bowed forwardly from the rear edge 11' of the body portion so that the central portion **14*a* of the flange is spaced forward of its lower and upper edges 11' and 14*b* respectively. An upstanding tongue 17 is stamped from the support portion 14 along a pair of parallel cut lines 18, 19 extending upwardly from the rear edge 11' of the body portion and a transverse cut line 20 connecting the upper ends of the parallel cut lines. The tongue 17 is substantially perpendicular to the body portion 11 whereas the support portion 14 is bowed forwardly thereof. An aperture 21 is provided in the upstanding support portion 14 above the transverse cut line 20 for receiving a nail or other suitable fastener 22 (FIG. 2) used in securing the hanger 10 to the facia board 23**, or other vertical wall structure, adjacent the eaves of a building.

Figure 2:
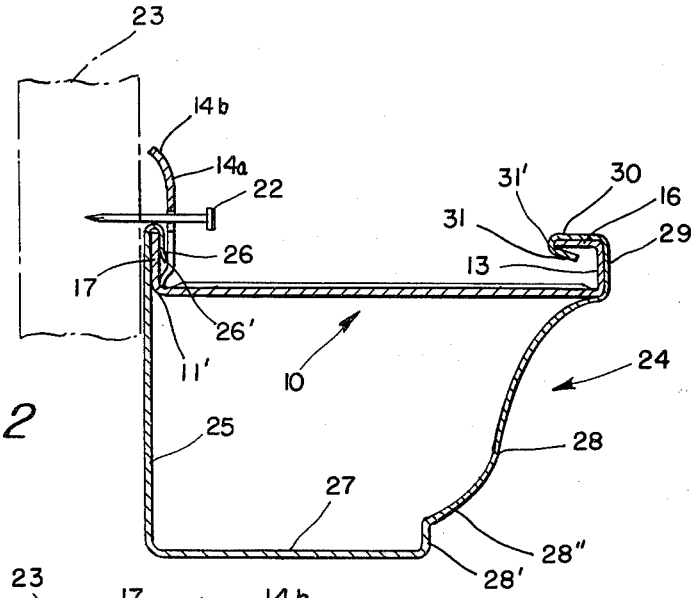
FIG. 2 is a vertical cross-sectional view of a gutter and the gutter hanger of FIG. 1 showing the gutter supported by the gutter hanger from a building wall (shown in phantom)

The hanger 10 is especially adapted for use with an open top, trough-shaped rain gutter 24 of the type shown in vertical cross section in FIG. 2. The gutter 24 comprises a flat vertical rear wall 25 which terminates at its upper end in an inwardly and downwardly reversely bent portion forming a downwardly open rear hook 26, a bottom wall 27 perpendicular to the rear wall and a front wall 28 extending upwardly from the bottom wall. The front wall 28 includes a lower front wall portion 28' which is substantially perpendicular to the bottom wall 27, an intermediate portion 28'' formed with the conventional ogee type of curve and an upper front wall portion 29 which is substantially parallel to the rear wall 25. A horizontal flange 30, extending inwardly from the top edge of the upper front wall portion 29, terminates in a downwardly and forwardly reversely bent edge portion 31. The horizontal flange 30 and reversely bent edge portion 31 form a downwardly and forwardly open gutter front hook 31' extending inwardly of the upper front wall portion 29.

The hanger 10 is shown in FIG. 2 spanning the open top of the gutter 24 with its upstanding tongue portion 17 seated in the downwardly open rear hook of the gutter and with the rearwardly extending flange 16 of its front hook portion 13 seated in the oppositely directed gutter front hook 31'.

Figure 3:
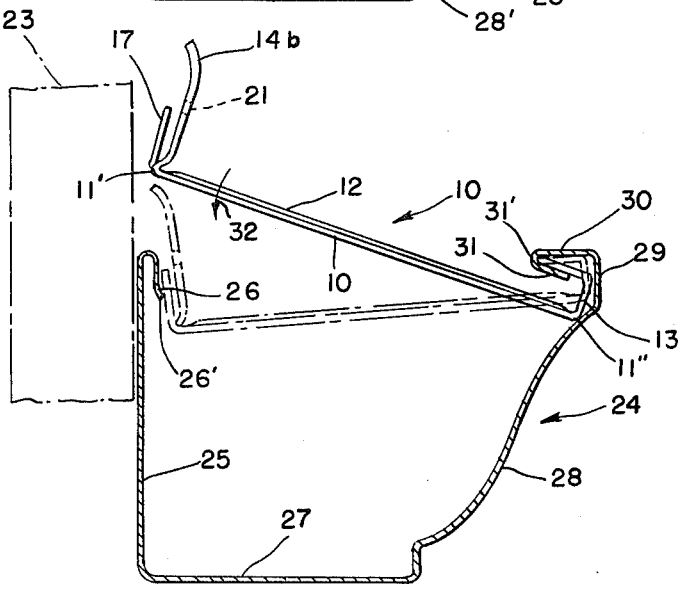
FIG. 3 is a side elevational view of the hanger of FIG. 1 showing it in solid lines in a first stage during the process of attaching the hanger to a gutter and further showing it in dotted lines in an advanced stage of being installed.

The manner of installing a gutter hanger 10 on the gutter 24 is indicated in FIG. 3. The front hook 13 of the hanger is first seated in the oppositely directed front gutter hook 31' formed between the horizontal flange 16 and the reversely bent edge portion 31, by inclining the hanger 10 relative to the gutter 24 as shown in solid lines in FIG. 3. Once the front hanger hook is seated in the front gutter hook, the rear end of the hanger is lowered, rotating the hanger as indicated by arrow 32 about the point of contact between the free end of flange 16 of the front hanger hook and its seat in the front gutter hook. The position of the hanger 10 just before the tongue 17 of the hanger snaps under the lower edge 26' of the rear gutter hook is shown in dotted lines in FIG. 3. Once the tongue 17 snaps under the edge 26', which is inwardly flared to provide a cam surface tending to spring the tongue 17 inwardly as the rear end of the hanger is lowered into the gutter, the rear end of the hanger is raised to slide a tongue 17 into the rear gutter hook 26. With the tongue 17 firmly seated in the hook 26, a nail 22 is inserted through the hole 21 in support portion 14 of the gutter hanger, and when the gutter and hanger have been raised to the desired position beneath the eaves of a building, the nail is driven into the facia board, or other vertical building structure beneath the eaves, drawing the rear wall of the gutter up tight against the facia board. As clearly shown in FIG. 2, the nail 22 when driven into the facia board 23 is located immediately above the top of the rear wall 25 so that the nail will prevent any upward displacement of the gutter in response to an upward force applied thereto, and the tongue 17 of the hanger seated in the hook 26 prevents any downward movement of the rear wall of the gutter. FIG. 2 also shows that the height of the leg 15 and the width of the flange 16 are selected to correspond closely to the inside surface height and width of the upper wall portion 29 and horizontal flange 30 so that the leg 15 fits snugly against the upper wall portion 29 between flange 30 and the intermediate front wall portion 28'', and the flange 16 fits snugly between the upper front wall portion 29 and the reversely bent edge portion 31.

Figure 4:
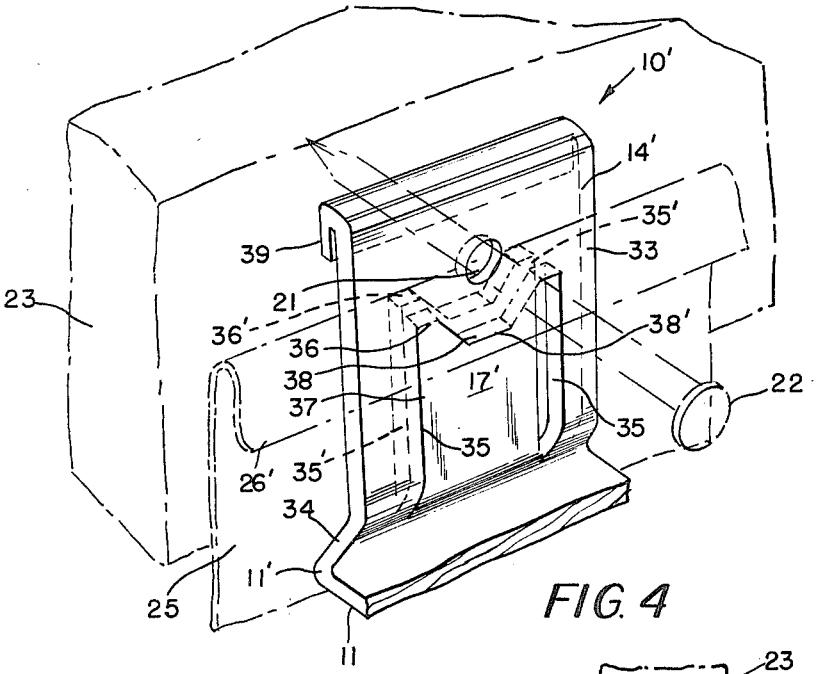
FIG. 4 is a perspective fragmentary view of another form of the new gutter hanger showing only the portion of the hanger which differs from the hanger of FIG. 1.
Figure 5:
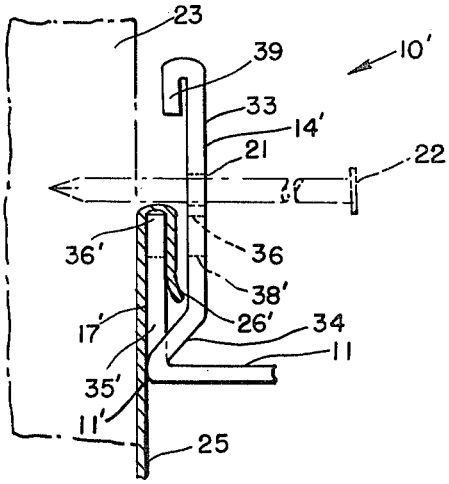
FIG. 5 is a fragmentary side elevational view of the gutter hanger portion shown in FIG. 4.

FIGS. 4 and 5 show the upstanding support portion 14' of another gutter hanger 10' which except for the upstanding support portion is identical to the hanger 10. The upstanding support portion 14' includes a flat plate portion 33 which is offset inwardly from the rear edge 11' of the hanger body portion 11 by an integral acutely inclined connecting portion 34, and extends substantially perpendicular to the body portion 11. A vertical tongue 17', struck out of the upstanding support portion 14' along upper edge 36 and side edges 35 extends perpendicularly upward from the rear end 11' of body portion 11 and is spaced rearwardly of the inwardly offset flat plate portion 33 by a distance approximately equal to the thickness of the material from which a gutter is formed. The tongue 17′ has parallel vertical side edges 35′,35′ and a notched upper edge 36′ and it leaves an opening 37 in the upstanding support portion corresponding to its shape. Thus, at the upper edge 36 of the opening 17, a tab 38 extends downwardly into the space from which the notched upper end of the tongue 17′ was struck. The upper end of the flat plate portion 33 is folded rearwardly and down to provide a reversely bent portion 39 which is substantially parallel to the plate portion 33. A nail receiving hole 21 extends centrally through the flat plate portion above the notched upper edge 36′ of the tongue 17′.

The gutter hanger 10′ having the upstanding support portion 14′ has two important features. The folded end 39 provides a spacer between the flat plate portion 33 and the facia board of a building, so that when a nail is driven through the nail hole 21 into the facia board and draws the gutter supported by the hanger and the hanger up tight against the facia board, the upstanding portion 14′ will be nearly parallel to the facia board. The tab 38 is incorporated to assure that the lower edge 38′ of the tab 38 is sufficiently below the gutter edge to prevent riding or seating of the edge 38′ above the gutter's top edge when a nail is driven down tight.

Figure 1:
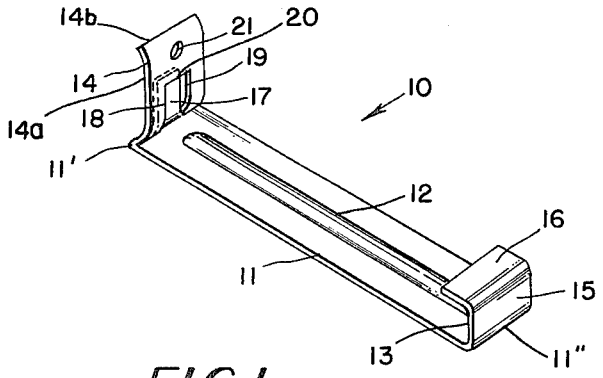
FIG. 1 is a perspective view of one form of the new gutter hanger of this invention.
Figure 6:
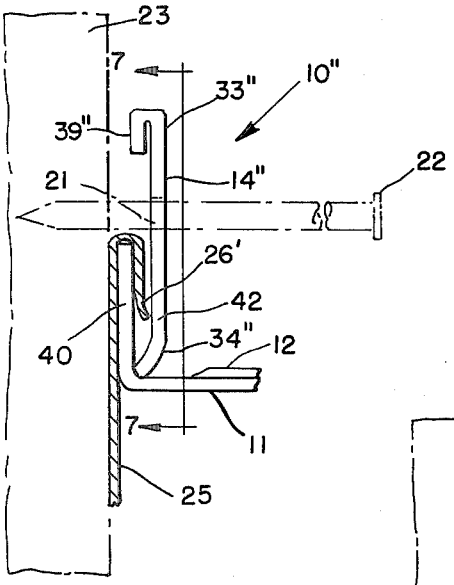
FIG. 6 is a fragmentary side elevational view of still another form of the invention showing only the portion of the hanger which differs from the hanger in FIG. 1.
Figure 7:
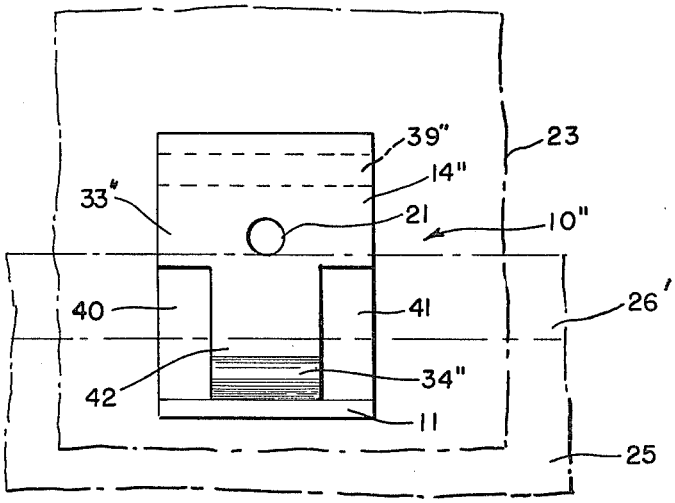
FIG. 7 is a fragmentary front elevational view of the portion of the hanger shown in FIG. 6.

Still another form of the invention is partially shown in FIGS. 6 and 7. The gutter hanger 10″ differs from the gutter hanger 10 shown in FIG. 1 only in the upstanding portion of the hanger for which reason only a fragmentary view of the gutter hanger 10″ is shown. The upstanding portion 14″ of gutter hanger 10″ includes an inwardly offset flat plate portion 33″ connected to the rear end 11′ of the body portion 11 by an integral connecting portion 34″, and a folded end portion 39″. A hole 21 extends through the flat plate portion 33″ to receive a nail for nailing the hanger 10″ to a facia board. The upstanding portion 14″ instead of having a single central tongue struck therefrom as in the upstanding support portions of hangers 10 and 10′, has two rectangular tongues 40,41 struck therefrom on opposite sides of a central leg 42.

In use the two tongues 40,41 seat in the rear hook 26 of a gutter in the same manner as does the single tongue 17 of the gutter hanger 10. The folded portion 39″ provides a spacer between the flat plate portion 33″ and the wall surface against which the hanger 10″ is fastened.

While in the foregoing there have been described and shown preferred embodiments of the invention, various modifications and equivalents may be resorted to within the spirit and scope of the invention as claimed.

What is claimed is:

1. A one-piece gutter hanger for supporting an open top, trough-shaped rain gutter adjacent to the eaves of a building, the gutter being of a type comprising a flat rear wall having an inwardly and downwardly reversely bent upper edge portion forming a downwardly open rear gutter hook, a bottom wall extending forwardly of the rear wall, a front wall extending upwardly from the bottom wall opposite the rear wall and having an upper wall portion, a horizontal flange extending inwardly from the top of the upper wall portion terminating in a downwardly and forwardly reversely bent edge portion to form a downwardly and forwardly open front gutter hook, said gutter hanger comprising an elongated body portion of a length to span the open top of the gutter, hook means at one end of the body portion for inter-engaging the front gutter hook, and an upstanding support portion formed integrally with the other end of the elongated body portion, said upstanding support portion including an inwardly offset main portion and at least one upstanding tongue struck therefrom and bent upright from said elongated body portion, said tongue being spaced outwardly from the inwardly offset main portion of said upstanding portion and adapted to seat in the rear gutter hook, said main portion of said upstanding portion being longer than said tongue so as to extend above the top edge of a gutter when the tongue is seated in the rear gutter hook, and a hole through the main portion of said upstanding portion above said tongue for receiving a nail, said hole being spaced relative to said tongue so that when the tongue engages the rear gutter hook and the front hanger hook engages the front gutter hook, a nail driven through said hole into a vertical building surface beneath the eaves will draw the gutter and hanger tight against the vertical wall and lock the hanger relative to the gutter to prevent separation of the hanger from the gutter without piercing the gutter.

2. The gutter hanger of claim 1 wherein said elongated body portion includes a longitudinal reinforcing rib.

3. The gutter hanger of claim 1 wherein there is a single centrally located tongue struck out of said upstanding support portion, leaving a central opening therein.

4. The gutter hanger of claim 3 wherein said tongue is rectangular in shape.

5. The gutter hanger of claim 4 wherein said tongue has a notched upper edge, and said upstanding support portion has a tab depending into the opening from which said tongue was struck.

6. The gutter hanger of claim 1 wherein said upstanding support portion has a reversely bent upper edge portion bent outwardly and downwardly from the upper end of said inwardly offset main portion.

7. The gutter hanger of claim 6 wherein there is a single upstanding tongue struck out of said upstanding support portion.

8. The gutter hanger of claim 6 wherein there are two upstanding tongues struck out of said upstanding support portion along opposite sides thereof.

9. The combination of an open top, trough-shaped rain gutter adapted to be supported against a vertical wall surface adjacent the eaves of a building comprising a rear wall, a bottom wall integrally connected to the rear wall, and a front wall integrally connected to the bottom wall opposite said rear wall, said rear wall having an inwardly and downwardly reversely bent upper edge portion forming a downwardly open rear gutter hook, said front wall having a flange extending inwardly from the top of said front wall and terminating in a downwardly and forwardly reversely bent edge portion forming a downwardly and forwardly open front gutter hook, and a gutter hanger comprising an elongated body portion of a length to span the open top of the gutter, hook means at one end of the body portion interengaging said front gutter hook, and an upstanding support portion formed integrally with the other end of the elongated body portion, said upstanding support portion including an inwardly offset main portion and at least one upstanding tongue struck therefrom and bent upright from said elongated body portion, said tongue being spaced outwardly from the inwardly offset main portion of said upstanding portion and seated in said rear gutter hook, said main portion of said upstanding portion being longer than said tongue so as to extend above the top edge of said gutter when the tongue is seated in said rear gutter hook, and a hole through the main portion of said upstanding portion above said tongue for receiving a nail, said hole being spaced relative to said tongue so that a nail driven through said hole into a vertical building surface beneath the eaves will draw the gutter and hanger tight against the vertical wall and lock the hanger relative to the gutter to prevent separation of the hanger from the gutter without piercing said gutter.

* * * * *